US007035557B2

(12) United States Patent
Boness et al.

(10) Patent No.: US 7,035,557 B2
(45) Date of Patent: Apr. 25, 2006

(54) METHOD FOR CORRECTION OF THE CALIBRATION OF A REGISTER MARK ACCURATE PRINTING PROCESS

(75) Inventors: Jan Dirk Boness, Bad Bramstedt (DE); Ingo Klaus Michael Dreher, Kiel (DE); Heiko Hunold, Wattenbek (DE); Stefan Schrader, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 118 days.

(21) Appl. No.: 10/769,353

(22) Filed: Jan. 30, 2004

(65) Prior Publication Data

US 2004/0234284 A1 Nov. 25, 2004

(30) Foreign Application Priority Data

Feb. 5, 2003 (DE) ..... 103 04 763

(51) Int. Cl.
*G03G 15/00* (2006.01)

(52) U.S. Cl. ..... 399/38; 399/49; 399/72

(58) Field of Classification Search ..... 399/38, 399/39, 42, 49, 72, 40, 46; 101/481, 484, 101/485; 347/116; 700/124
See application file for complete search history.

(56) References Cited

U.S. PATENT DOCUMENTS

| | | | | |
|---|---|---|---|---|
| 6,493,012 | B1 | 12/2002 | Buch et al. | 347/116 |
| 6,522,857 | B1 | 2/2003 | Dreher et al. | 399/301 |
| 6,744,997 | B1 * | 6/2004 | Burkes et al. | 399/72 |
| 6,817,295 | B1 * | 11/2004 | Metzler | 101/486 |
| 6,829,456 | B1 * | 12/2004 | Regimbal et al. | 399/167 |
| 6,836,635 | B1 * | 12/2004 | Metzler et al. | 399/301 |

* cited by examiner

*Primary Examiner*—Hoan Tran
(74) *Attorney, Agent, or Firm*—Lawrence P. Kessler

(57) ABSTRACT

A method for correction of the calibration of the register mark accurately and/or register accurate printing process of an electrophotographic printing unit, preferably of a color-printing unit. Large surface toner fields are placed on a conveyor belt for the substrate to be printed, particularly in the larger spaces between the substrate sheets to be printed. The influence of a toner field placed on a conveyor belt for print substrate sheets on the register mark and/or registration of the printing process is identified, and such influence is expressed in the form of at least one correction value or parameter suitable for the correction of the calibration.

5 Claims, 1 Drawing Sheet

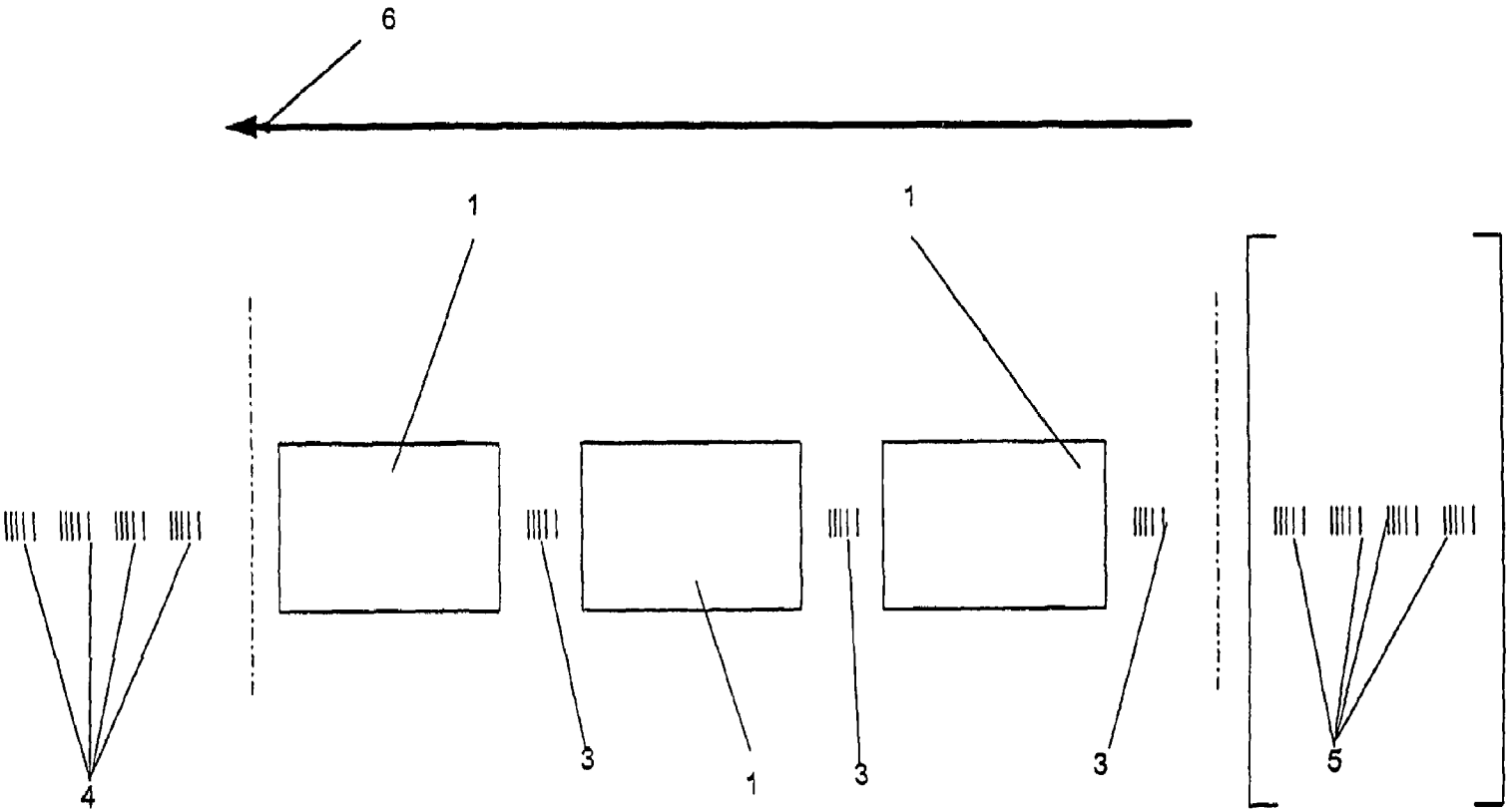
6
1
1
1
3
3
3
5
4

METHOD FOR CORRECTION OF THE CALIBRATION OF A REGISTER MARK ACCURATE PRINTING PROCESS

FIELD OF THE INVENTION

The invention relates to a method for correction of the calibration of the register mark accurately and/or register accurate printing process, of an electrophotographic printing unit, preferably of a color-printing unit.

BACKGROUND OF THE INVENTION

A method for the calibration of the color printing process mentioned above is shown in U.S. patent application Ser. No. 10/681,849, filed on Oct. 8, 2003. Furthermore, a method for determining register errors has been described in U.S. patent application Ser. No. 10/208,216, filed on Jul. 30, 2002.

It is known that contingent on the print substrate itself, register mark errors that is, errors in the precise stacked printing of the color separations, may occur in the case of color printing, and may influence particularly the circumference register, or the so-called intrack register in the direction of the printing process. As a result, register mark errors, i.e. errors in the precise positioning of a print layout on a printed sheet, may also occur particularly in the circumference register within the color or monochrome printing process. The terms "register" or "registration", also are used in the following in the broader sense as the generic terms, including the register mark. Conversely, the explanations provided only for the register mark analogously are often also true for the register.

In the case of print substrate conditional register mark errors, i.e. errors which adversely affect the registration of the color separation processes of a color print relative to each other, and individually to the substrate to be printed, particularly the so-called gear register mark error, the so-called creep register mark error, and the so-called print substrate conditional magnification register mark error, which should not be confused with the periodic magnification error caused by a concentricity error, can be differentiated.

The gear register mark error can be caused by the fact that a print substrate is forced through the narrow gap (nip) between the conveyor belt and a printing organ or transfer organ (for example, a rubber blanket cylinder), respectively; the print substrate is driven by the movement and transfers the print layout onto the substrate to be printed, the speed of which is thereby changed (as, for example, in a gear drive by the change of the transmission ratio).

The creep register mark error can be caused by the fact that the surface of the substrate (so to speak ranking on a curved path) to be printed in a re-directional range, or otherwise curved path of the conveyor belt, is positioned on a different radius toward the re-directional or curvature axis than the surface of the conveyor belt and, therefore, has a different path speed.

The print substrate conditional magnification register mark error can be caused by the fact that a print substrate is forced through the narrow gap (nip) between the conveyor belt and printing organ or transfer organ, respectively, transferring the print layout onto the substrate to be printed, the shape of which is thereby changed, which may lead to the spreading or enlargement of the print layout in the running direction of the print substrate.

The previous paragraphs each list which cause may be responsible for the respective register mark error, because the causes may be very complex and, ultimately, are not safely and completely clarified. For example, temperature or moisture fluctuations may also be responsible for the register mark error. In particular, however, register mark errors turn out to be of various sizes depending on the print substrate, for instance, depending on the format, thickness, coating, history, etc. Therefore, any correction performed online is particularly desired. Always important, however, is the correction of the error, regardless of whether the cause of the error has been completely researched or not. The identification of the error is therefore not a determination of a cause, but in any event, a type of classification with regard to a possibility of elimination of the respective error, and, better yet, serves merely for easing the communications among experts in the field.

The previously mentioned U.S. Patent Applications include methods which enable the determination of correction values or parameters for the print substrate conditional register mark errors, which make it possible to correct the printing process with regard to the register mark accuracy, thereby improving the same. For this purpose, the correction values obtained by respective calibration runs can be stored in a correction table based on the print substrate, and the substrate sheets to be printed can be corrected for the printing process by accessing this table.

However, it may also be provided that large-surface toner fields are placed on a conveyor belt for the substrate to be printed, especially in the larger spaces located between the print substrate sheets, which would fit into a print substrate sheet, but for which for whatever reason no print substrate sheet has been provided, for instance, in the currently running printing job, which means that a respective clearance remains. In other words, a window or frame would exist, however, for inserting a print substrate sheet in the control of the printing process. Such a window, or such a clearance is now being used in order to place a toner field onto the largely free conveyor belt, preferably in the size of a print substrate sheet, preferably corresponding to the size of a maximum sized sheet of, for example, 470 mm by 343 mm.

It is, in fact, a known problem that with electro-photographic printing, if a toner layout is fixed with a roller fixing device using fixing oil, oil can be carried off up to the area of the illustration station by a subsequent reverse printing, where it may lead to problems: because it dirties, for instance, a photoconductor, or a rubber blanket. By a large-surface toner field placement on the conveyor belt, such oil residue, for example, can be safely bound in the toner, and later removed.

Oil residue can thereby be prevented from reaching the printing layout of the print substrate sheet to be printed next, thus influencing the print layout in that area.

SUMMARY OF THE INVENTION

It is the task of the invention to improve a method of the calibration of the register mark accurate printing process. In this regard, the invention recognizes that such a toner field might lead to register mark errors.

As a solution of the task at hand, it is therefore provided according to the invention that the influence a toner field placed on a conveyor belt for print substrate sheets has on the register mark, and/or the registration of the printing process, is determined and expressed in the form of at least one correction value or parameter suitable for the calibration correction.

According to the invention, such a toner field is also beneficially considered in or by calibration. Preferably, the toner field is treated as a print substrate sheet made of a special print substrate. Errors caused by the toner field probably occur through changes in the frictional resistance between the conveyor belt and a printing organ or transfer organ, respectively, being driven by the movement, and transferring the print layout onto the substrate to be printed, because the toner field replaces the conveyor belt section-by-section with its other friction coefficient. In the same manner, a change of the frictional resistance or the infeed can lead to such errors due to the toner field passing through between several subcarriers that move along with it, such as between the photoconductor and the rubber blanket cylinder. Primarily, this can therefore cause a gear register mark error, possibly also a magnification register mark error. If these additional register mark errors were not considered by the toner fields, the correction of print substrate conditional register mark errors would become inadequate and, during the continued printing process, less and less reliable.

Preferably, it is provided that at least one of the correction parameters is stored similarly to a correction value for the influence of a certain print substrate in a correction value table, which is accessible for the registration of print substrate sheets for the printing process.

A further embodiment of the invention provides that in order to identify the influence of a toner field, and to determine at least one of the correction parameters for a calibration run, at least one of the toner fields is placed on the conveyor belt, at least one of the register marks is placed in front of the toner field, and at least one of the register marks is placed behind the toner field on the conveyor belt, whereby each of the register marks comprises markings of colors provided for the color printing process, and these register marks are recorded by measurement.

The print substrate-based calibration is therefore supplemented or corrected by a local respective calibration run with at least one toner field.

"Color" is to be understood in the broadest sense in this regard. It may mean the colors commonly used in a four-color printing process: cyan, magenta, yellow, and black, or also other special colors, colorless toners, paints, or such, which could be added to the print layout using a print substrate station in the manner of a color separation process.

Preferably, the invention provides that instead of at least one of the individual register marks, a multitude of register marks is used, the measurement results of which, or the measurement results of its respective same-color markings, are averaged.

By using a multitude of register marks, more information can be gathered in one measurement run, which serves to recognize and eliminate register mark errors more reliably, especially in light of register mark errors to be remedied and resulting from different causes, preferably also the magnification register mark error that cannot be recognized with individual register marks. On the other hand, the process operates relatively quickly by reporting information. It is suitable for online applications.

Furthermore, it may be provided that a multitude of toner fields that are positioned at a distance from each other is placed in a row on the conveyor belt, and that at least one register mark each is placed on the conveyor belt in the spaces between two successive toner fields, whereby averages are calculated of the register marks, or of their respective same-color markings positioned in the spaces between the toner fields, preferably by the measurement results.

As mentioned above, the invention may specifically provide that a so-called gear register mark error is corrected, which is caused by the fact that a toner field is forced through the narrow gap (nip) between the conveyor belt and printing organ or transfer organ, or between a transfer organ and an illustration organ, respectively, transferring the print layout onto the substrate to be printed, the speed of which is thereby changed, and/or that a so-called magnification register mark error is corrected, which is caused by the fact that a toner field is forced through the narrow gap (nip) between the conveyor belt and printing organ or transfer organ, or between a transfer organ and an illustration organ, respectively, transferring the print layout onto the substrate to be printed, the shape of which is thereby changed.

A further embodiment of the method according to the invention provides that from the available multitude of toner fields, and/or of the register marks attached in the spaces between the toner fields, only a selected, predetermined amount is used.

Additionally, a multitude of register marks is preferably successively placed on the conveyor belt in front of the entirety of toner fields, and/or behind the entirety of the toner fields whereby, in particular, the register marks behind the toner fields could also be omitted.

With the exact amount of the multitude of register marks and toner fields, an optimum of reliability of error determination and time exposure should be found for the required measurements.

The multitude of register marks in front of and/or behind the toner fields should each be of an approximate magnitude of 20 to 60 register marks, whereby, preferably the same amount of register marks should be used in front of and behind the toner fields.

The suitable amount of toner fields in a special electrophotographic printing machine, only as an example, is approximately 18 toner fields.

It may possibly be provided that not all available register marks, and/or toner fields are actually used for the measurement of parameters.

With the register mark diagram according to the invention, and the related calibration sequence, it is possible to identify gear and magnification register mark errors reliably and quickly in only one or two measurement runs.

The amount and the diagram of the register marks is not defined exactly for this purpose, but can change instead depending on demand and given factors, in the same manner as the calibration sequence.

BRIEF DESCRIPTION OF THE DRAWING

One embodiment example of a register mark diagram for executing the method, according to the invention, from which additional inventive characteristics may also arise to which the invention is not limited in its coverage is illustrated in the only drawing FIGURE, and is explained thereafter in greater detail but, as mentioned, only as an example.

DETAILED DESCRIPTION OF THE INVENTION

The drawing shows an example of the register mark diagram according to the invention, which is illustrated by dash-dot-dash lines, and only partially in three sections for reasons of drawing to scale. Three toner fields 1 are indicated in the center section of the three sections, between the dash-dot-dash lines, which are placed on a conveyor belt that is not illustrated, and are transported by the same in the direction of the arrow 6. Register mark-like markings may also be provided on each of the toner fields 1, themselves. Register marks 3 are attached on the conveyor belt between the toner fields 1. As indicated in the drawing, the three drawn toner fields 1 preferably symbolize eighteen toner fields, which are placed in a row on the conveyor belt.

In the section of the conveyor belt located in front of the toner fields 1 in the transport direction 6, twenty register marks 4 are placed on the conveyor belt in the illustrated example, of which, however, only four register marks 4 are shown for reasons of lack of space. The illustrated example also provides that twenty register marks 5 are placed on the conveyor belt behind the toner fields 1, again, of which only four register marks 5 are illustrated.

As previously mentioned, the register marks 5 may also be completely omitted, for example, or a different amount of register marks 4, 5 other than twenty could be provided.

The following serves to explain the gear register mark error in detail, as to how each of the same, or related parameters is identified.

The gear parameter for a toner surface is calculated for a certain color from the measured register mark data RegData as follows (even if the toner surface is, for example, printed only in black, all colors are influences with respect to their registration):

$$Gear_{Color} = -\left((RegData_{Color,Patch})_{EffBatch} - \frac{((RegData_{Color,Patch})_{PrePrintCal} + (RegData_{Color,Patch})_{PostPrintCal})}{2}\right)$$

In case the register marks 5 are omitted, the gear parameter is calculated as follows:

$$Gear_{Color} = -\left((RegData_{Color,Patch})_{EffBatch} - (RegData_{Color,Patch})_{PrePrintCal}\right)$$

The square brackets < > denote a notification on the succession described as the index, in these cases on the register marks 3 (EffBatch) used for the measurement of the gear parameters, as well as the register marks 4 of the so-called preprint calibration (PrePrintCal); if the register marks 5 are not omitted from the beginning, as described above.

The size EffBatch accounts for the fact that not all, for example, 18 marks of a succession of toner fields are used for the calculation, but instead only, for example, 11 values as is the case with the circumference register mark calibration for large sheets (A3, A3+, Tabloid, etc.). This corresponds to a full allocation of the conveyor belt with large toner surfaces so that any remaining errors, which are based on the special position of the sheet of the conveyor belt, are identified.

In color printing, the variable color may assume the values cyan, magenta, yellow, or black of a normal four-color printing process in the printing machine, or additionally, or alternatively also additional colors, including colorless toner, or paint, if necessary.

The index patch displays the data coming from marks printed on the conveyor belt.

The invention has been described in detail with particular reference to certain preferred embodiments thereof, but it will be understood that variations and modifications can be effected within the spirit and scope of the invention.

What is claimed is:

1. Method for correction of the calibration of the register mark accurate and/or register accurate printing process of an electrophotographic printing unit, preferably of a color printing unit, comprising: identifying the influence of a toner field that is placed on a conveyor belt for print substrate sheets on the register mark, and/or registration of the printing process, and expressing such influence in the form of at least one correction value or parameter suitable for the correction of the calibration, at least one of the correction parameters for the influence of a certain print substrate is stored in a correction value table which is accessible for the registration of print substrate sheets for the printing process, and wherein, for identifying the influence of a toner field, and for determining at least one of the correction parameters for a calibration run, at least one such toner field is placed on the conveyor belt, and at least one register mark is placed on the conveyor belt in front of the toner field, and at least one register mark is placed on the conveyor belt behind the toner field, whereby each of said register mark markings is comprised of colors provided for the four-color printing process, and these register marks are recorded by measurement.

2. Method according to claim 1, wherein, a multitude of register marks is used for averaging by their measurement results, or the measurement results of their respective same-color markings.

3. Method according to claim 2, wherein, a multitude of toner fields that are positioned at a distance to each other along the transport direction are placed in a row on the conveyor belt, and that at least one register mark is placed on the conveyor belt in each of the spaces between two successive toner fields.

4. Method according to claim 3, wherein, averaging is performed by the measurement results of register marks located in the spaces between the toner fields, or their respective same-color markings.

5. Method according to claim 4, wherein, of the available multitude of toner fields, and/or the register marks placed in the spaces between the toner fields only a selected, predetermined amount is used.

* * * * *